US005984841A

United States Patent [19]

John

[11] Patent Number: 5,984,841

[45] Date of Patent: Nov. 16, 1999

[54] SHOWER EXERCISE DEVICE

[76] Inventor: Mariamma John, 963 Cherrywood Dr., Baldwin Harbor, N.Y. 11510

[21] Appl. No.: 09/001,443

[22] Filed: Dec. 31, 1997

[51] Int. Cl.[6] ..... A63B 22/09

[52] U.S. Cl. ..... 482/79; 482/52; 482/53; 482/80

[58] Field of Search ..... 482/51, 79, 53, 482/52, 80, 74, 148, 111, 112

[56] References Cited

U.S. PATENT DOCUMENTS

| | | | |
|---|---|---|---|
| 1,509,793 | 9/1924 | Thompson | 482/79 |
| 4,371,160 | 2/1983 | Shooltz | 482/80 |
| 5,160,303 | 11/1992 | Smith | 482/79 |
| 5,199,934 | 4/1993 | Lin | 482/79 |
| 5,256,118 | 10/1993 | Chen | 482/80 |
| 5,267,923 | 12/1993 | Piaget et al. | 482/52 |
| 5,433,684 | 7/1995 | Carrillo | 482/80 |

*Primary Examiner*—Jerome Donnelly

[57] ABSTRACT

An exercise apparatus is provided including a frame and a pair of pedals pivotally coupled to the frame in a side-by-side relationship. A resistance mechanism is included for urging the pedals upwardly. Further, a fulcrum and rod combination is provided for ensuring that only one pedal is capable of being raised at a time.

4 Claims, 2 Drawing Sheets

SHOWER EXERCISE DEVICE

BACKGROUND OF THE INVENTION

1. Field of the Invention

The present invention relates to exercise apparatuses and more particularly pertains to a new shower exercise device for performing a stepping type exercise in a shower.

2. Description of the Prior Art

The use of exercise apparatuses is known in the prior art. More specifically, exercise apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise apparatuses include U.S. Pat. No. 5,385,525; U.S. Pat. No. 4,111,416; U.S. patent Des. 281,343; U.S. Pat. No. 5,352,173; U.S. Pat. No. 5,263,910; and U.S. Pat. No. 4,911,437.

In these respects, the shower exercise device according to the present invention substantially departs from the conventional concepts and designs of the prior art, and in so doing provides an apparatus primarily developed for the purpose of performing a stepping type exercise in a shower.

SUMMARY OF THE INVENTION

In view of the foregoing disadvantages inherent in the known types of exercise apparatuses now present in the prior art, the present invention provides a new shower exercise device construction wherein the same can be utilized for performing a stepping type exercise in a shower.

The general purpose of the present invention, which will be described subsequently in greater detail, is to provide a new shower exercise device apparatus and method which has many of the advantages of the exercise apparatuses mentioned heretofore and many novel features that result in a new shower exercise device which is not anticipated, rendered obvious, suggested, or even implied by any of the prior art exercise apparatuses, either alone or in any combination thereof.

To attain this, the present invention generally comprises a frame including a front strip having an inverted V-shaped central portion. As shown in FIG. 1, the central portion defines both a lower channel and a fulcrum. The frame further includes a pair of side strips each having a front end coupled to ends of the front strip in perpendicular relationship therewith. The front end of each side strip has a vertically oriented post coupled thereto and extended upwardly therefrom. Formed along a height of each post is an elongated channel. A top end of each vertically oriented post further includes an arm extending outwardly therefrom for reasons that will become apparent hereinafter. Next provided is a pair of pedals each having a rectangular planar configuration with a periphery. Such periphery is defined by a pair of long parallel side edges and a pair of short parallel end edges. A rear one of the end edges is pivotally coupled along an axis defined by rear ends of the side strips of the frame. Each pedal further has an arm extending outwardly from one of the side edges thereof. Such arm of each pedal is slidably situated within the slot of an associated one of the posts of the frame. Also included is a pair of elastic bands each mounted between the arm of a corresponding post of the frame and the arm of the associated pedal. During use, the bands urge the pedal upwardly. Finally, a rigid rod having a pair of ends is pivotally coupled to one of the side edges of the pedals. A center of the rod rests on the fulcrum defined by the central portion of the frame.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new shower exercise device apparatus and method which has many of the advantages of the exercise apparatuses mentioned heretofore and many novel features that result in a new shower exercise device which is not anticipated, rendered obvious, suggested, or even implied by any of the prior art exercise apparatuses, either alone or in any combination thereof.

It is another object of the present invention to provide a new shower exercise device which may be easily and efficiently manufactured and marketed.

It is a further object of the present invention to provide a new shower exercise device which is of a durable and reliable construction.

An even further object of the present invention is to provide a new shower exercise device which is susceptible of a low cost of manufacture with regard to both materials and labor, and which accordingly is then susceptible of low prices of sale to the consuming public, thereby making such shower exercise device economically available to the buying public.

Still yet another object of the present invention is to provide a new shower exercise device which provides in the apparatuses and methods of the prior art some of the advantages thereof, while simultaneously overcoming some of the disadvantages normally associated therewith.

Still another object of the present invention is to provide a new shower exercise device for performing a stepping type exercise in a shower.

Even still another object of the present invention is to provide a new shower exercise device that includes a frame and a pair of pedals pivotally coupled to the frame in a side-by-side relationship. A resistance mechanism is included for urging the pedals upwardly. Further, a fulcrum and rod combination is provided for ensuring that only one pedal is capable of being raised at a time.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
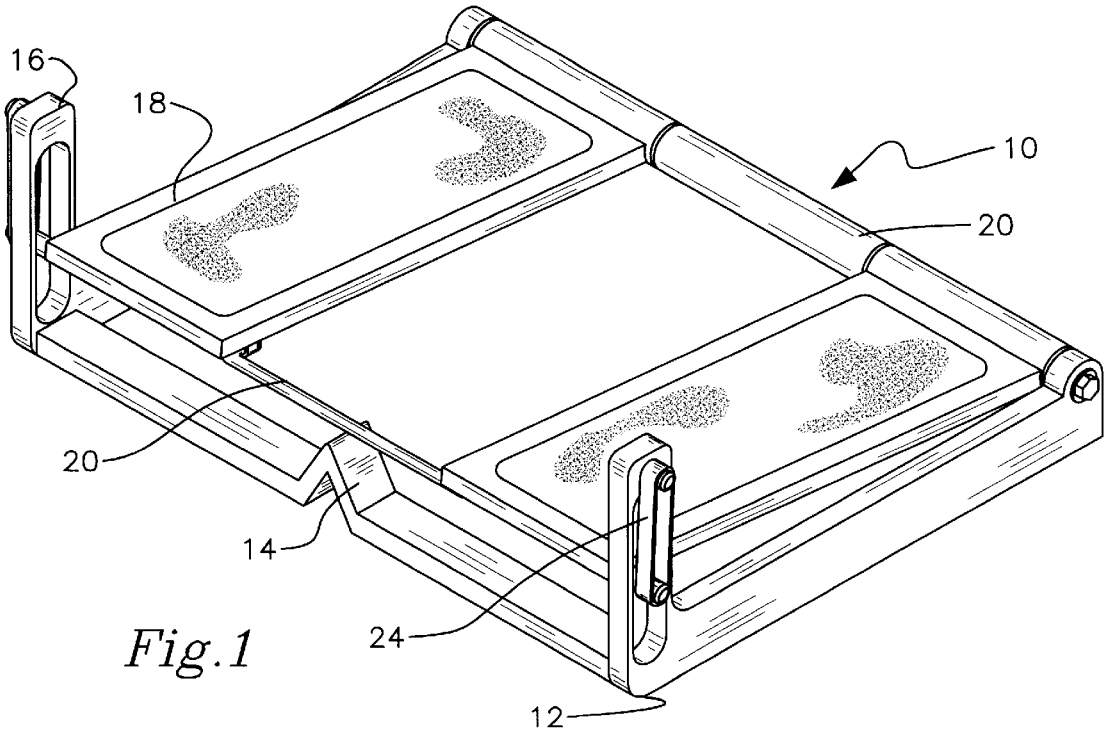
FIG. 1 is a perspective view of a new shower exercise device according to the present invention.
Figure 2:
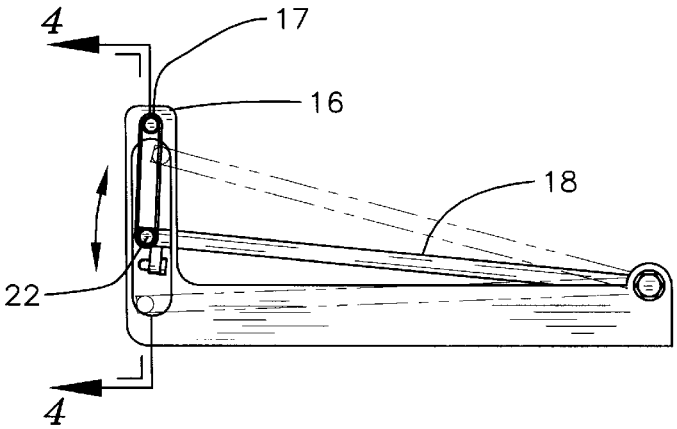
FIG. 2 is a side view of the present invention.

With reference now to the drawings, and in particular to FIGS. 1 through 4*b* thereof, a new shower exercise device embodying the principles and concepts of the present invention and generally designated by the reference numeral 10 will be described.

The present invention, designated as numeral 10, includes a frame 12 with a front strip having an inverted V-shaped central portion 14. As shown in FIG. 1, the central portion defines both a lower channel and a fulcrum. The frame further includes a pair of side strips each having a front end coupled to ends of the front strip in perpendicular relationship therewith. The front end of each side strip has a vertically oriented post 16 coupled thereto and extended upwardly therefrom. Formed along a height of each post is an elongated channel. A top end of each vertically oriented post further includes an arm 17 extending outwardly therefrom for reasons that will become apparent hereinafter.

Figure 3:
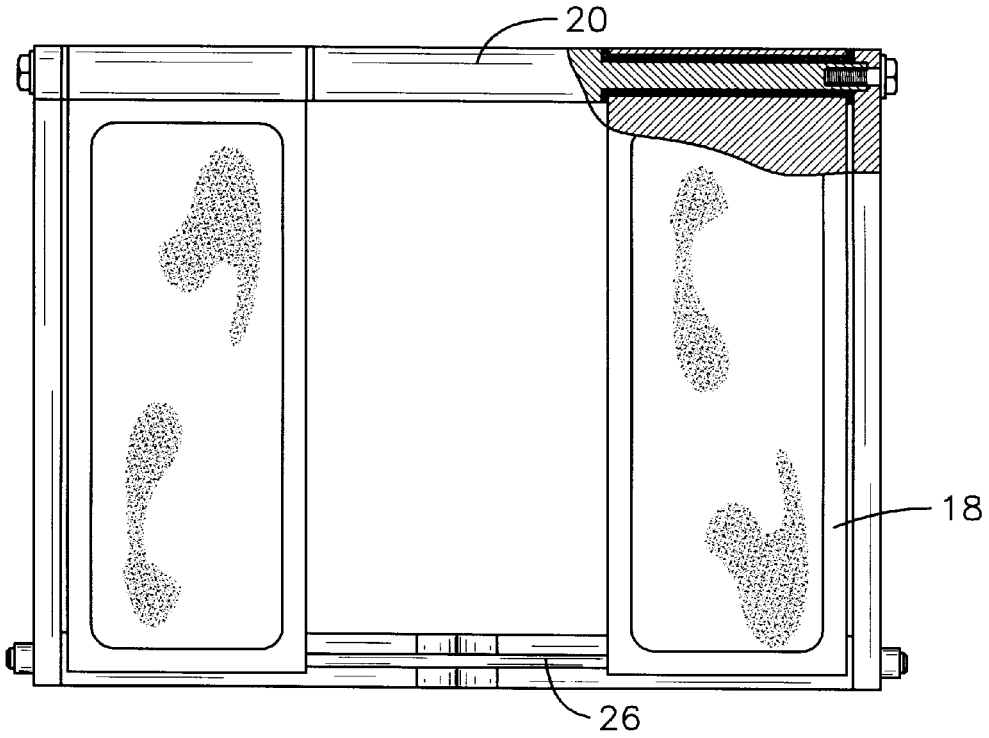
FIG. 3 is a top view of the present invention.
Figure 4A:
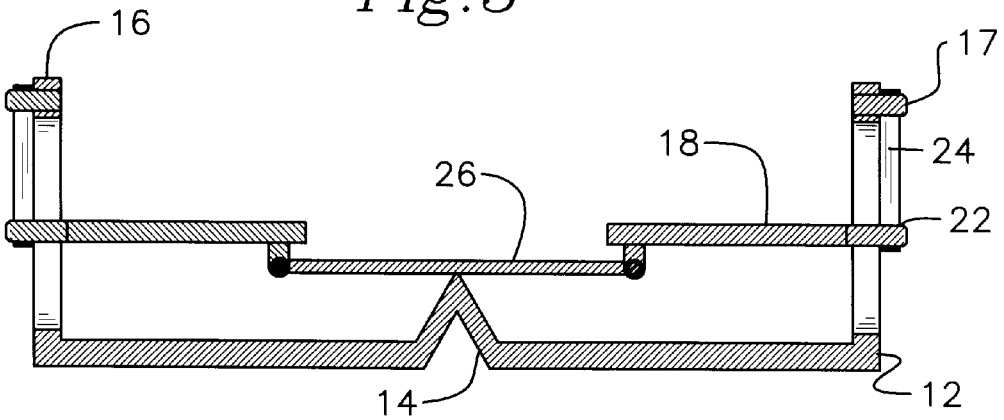
FIG. 4*a* is a front view of the present invention with the pedals at a common elevation.
Figure 4B:
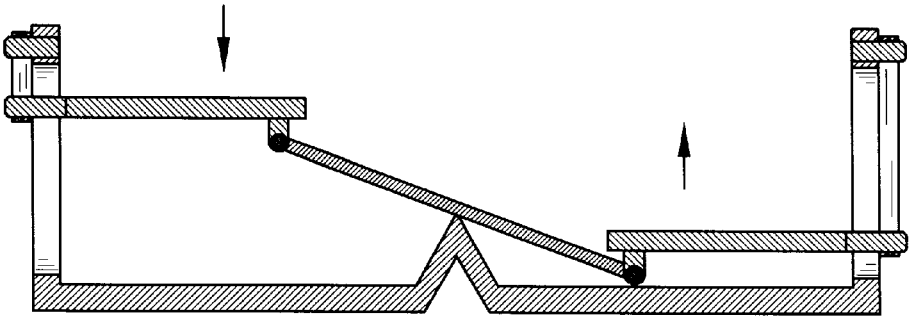
FIG. 4*b* is another view of the present invention during use.

Next provided is a pair of pedals 18 each having a rectangular planar configuration with a periphery. Such periphery is defined by a pair of long parallel side edges and a pair of short parallel end edges. A rear one of the end edges is pivotally coupled along an axis defined by rear ends of the side strips of the frame. Such is accomplished by way of an axle coupled between the rear ends of the side strips. Such axle is preferably elevated slightly from a recipient surface on which the frame rests. The rear edges of the pedals are equipped with sleeves for encompassing the axle. As shown in FIG. 3, a spacer 20 maintains the pedals in their proper lateral position. For providing a water tight seal about the axle, bushings are ideally situated between the pedals and spacer and ends. Further, a top surface of each pedal ideally has a gripping surface.

Each pedal further has an arm 22 extending outwardly from one of the side edges thereof. Such arm of each pedal is slidably situated within the slot of an associated one of the posts of the frame. It should be noted that the width of the slots is slightly greater that the width of the arms. In the preferred embodiment, each pedal has an area which is about ⅓ that defined by the frame. During operation, each pedal is preferably capable of about 30 degrees of angular rotation and further has a rest position 15 degrees above a horizontal.

Also included is a pair of elastic bands 24 each mounted between the arm of a corresponding post of the frame and the arm of the associated pedal. During use, the bands urge the pedals upwardly.

Finally, a rigid rod 26 has a pair of ends each pivotally coupled to one of the side edges of the corresponding pedal. Such is preferably accomplished by a small fork situated on a lower surface of each pedal which hingably receives the corresponding end of the rod. A center of the rod rests on the fulcrum defined by the central portion of the frame. As such, only one of the pedals may be raised at a time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A shower exercise apparatus comprising, in combination:

a frame including a front strip having an inverted V-shaped central portion defining both a lower channel and a fulcrum, the frame further including a pair of side strips each having a front end coupled to ends of the front strip in perpendicular relationship therewith, the front end of each side strip having a vertically oriented post coupled thereto and extending upwardly therefrom with an elongated channel formed along a height thereof, a top end of each vertically oriented post further including an arm extending outwardly therefrom;

a pair of pedals each having a rectangular planar configuration with a periphery defined by a pair of long parallel side edges and a pair of short parallel end edges, a rear one of the end edges being pivotally coupled along an axis defined by rear ends of the side strips of the frame, each pedal further having an arm extending outwardly from one of the side edges thereof and slidably situated within the slot of an associated one of the posts of the frame;

a pair of elastic bands each mounted between the arm of a corresponding post of the frame and the arm of the associated pedal, the bands urging the pedal upwardly; and a rigid rod having a pair of ends pivotally coupled to one of the side edges of the pedals and a center resting on the fulcrum defined by the central portion of the frame.

2. An exercise apparatus comprising:

a frame for being situated within a bathing stall;

a pair of pedals pivotally coupled along a common axis to the frame in a side-by-side relationship;

resistance means for urging the pedals upwardly;

an inverted V-shaped fulcrum mounted on the frame for ensuring that only one pedal is capable of being raised at a time; and a drainage channel formed in a lower surface of the frame and defined by the fulcrum for allowing water to flow past the frame to a drain of the bathing stall.

3. An exercise apparatus as set forth in claim 2 wherein the resistance means includes at least one elastic band.

4. An exercise apparatus as set forth in claim 2 wherein the frame includes a pair posts each with a slot formed therein for slidably receiving an arm of an associated one of the pedals.

* * * * *